United States Patent [19]

Kalil

[11] Patent Number: 4,460,377

[45] Date of Patent: Jul. 17, 1984

[54] CONTAINER FOR COMBUSTIBLE

[75] Inventor: Dennis G. S. Kalil, Johannesburg, South Africa

[73] Assignees: Ghalil Trevor Kalil; Donald Joseph Deeb, both of Johannesburg, South Africa

[21] Appl. No.: 381,337

[22] Filed: May 24, 1982

[30] Foreign Application Priority Data

May 26, 1981 [ZA] South Africa ..... 81/3511

[51] Int. Cl.[3] ..... C10L 11/06

[52] U.S. Cl. ..... 44/40

[58] Field of Search ..... 44/34, 38, 40, 41

[56] References Cited

U.S. PATENT DOCUMENTS

| | | | |
|---|---|---|---|
| 44,263 | 9/1864 | Thayer | 44/34 X |
| 286,103 | 10/1883 | Wood et al. | 44/40 |
| 2,212,157 | 8/1940 | Fernholtz | 44/38 X |
| 2,738,260 | 3/1956 | Wolfson et al. | 44/40 |
| 3,010,809 | 11/1961 | Peck | 44/40 |

FOREIGN PATENT DOCUMENTS

| | | | |
|---|---|---|---|
| 17734 | of 1887 | United Kingdom | 44/34 B |
| 25182 | of 1912 | United Kingdom | 44/34 |
| 418608 | 10/1934 | United Kingdom | 44/40 |
| 887048 | 1/1962 | United Kingdom | 44/40 |

*Primary Examiner*—Carl F. Dees

*Attorney, Agent, or Firm*—Lyon & Lyon

[57] ABSTRACT

A combustible pack comprising a hollow cardboard container divided by a bent strip of cardboard 28 into an upper compartment and a generally triangular lower compartment 30 and having a central flue 42 through the upper compartment and communicating with the lower compartment. An ignitor 44 is provided in the lower compartment and charcoal or the like is provided in the upper compartment on each side of the flue. The flue is formed by a cardboard strip 32 that is bent to extend between the top wall of the container and the dividing strip 28.

9 Claims, 1 Drawing Figure

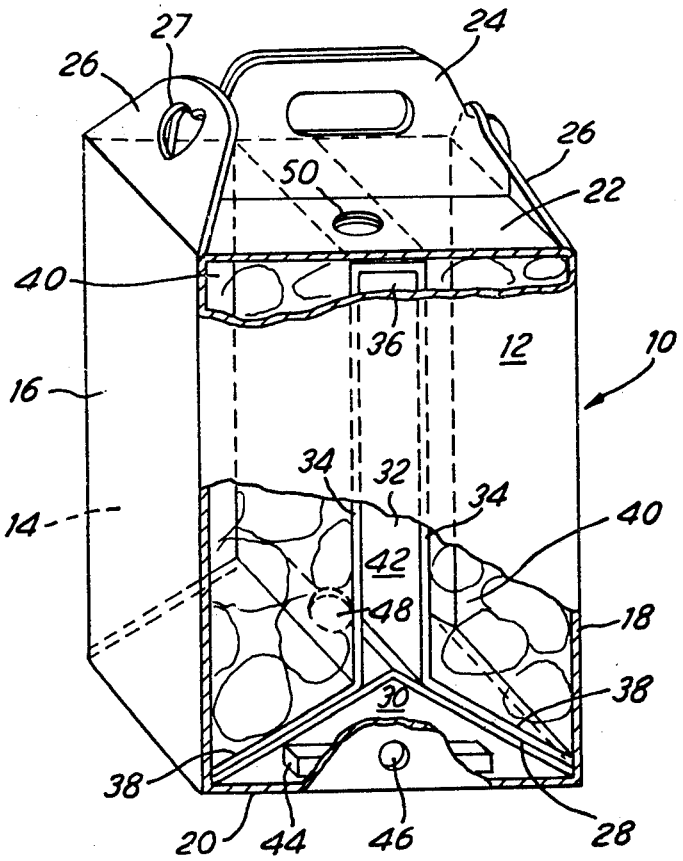
27
24
26
26
50
22
40
36
12
10
16
34
32
34
40
14
42
48
18
38
30
38
20
44
46
28

CONTAINER FOR COMBUSTIBLE

FIELD OF THE INVENTION

This invention relates to a combustible pack and a container for the combustible pack.

The invention is concerned with such a combustible pack of the kind (hereinafter called "the kind set forth") comprising a container having a hollow interior, divider means dividing the interior of the container into upper and lower compartments in the upper of which is contained combustible fuel material, such as charcoal, and the lower of which there is provided igniting such as a firelighter. The arrangement is such that in use the igniting means is ignited which then causes the combustible material to burn. This container is intended in use mainly to provide flammable material for use in a braaivleis or barbecue. An example of such a pack is shown in South African Patent No. 74/7339 T S Kalil.

SUMMARY OF THE INVENTION

According to one aspect of the present invention there is provided a combustible pack of the kind set forth including flue means in the container extending from the lower chamber through the upper chamber so as to facilitate combustion of the combustible material.

The container is preferably parallelipipedal in shape and is preferably formed from combustible paper mache or cardboard material as, preferably, are also the divider means and the flue means. Preferably the divider means is bent about a line in a medial region so that the lower compartment is generally triangular in shape and the flue means preferably extends from an upper portion of the bent divider means. There is preferably provided a port in the divider means communicating with the flue means.

According to another aspect of the invention there is provided in combination, a container, divider means for dividing the interior of the container into first and second compartments and flue means in and forming a flue through the second compartment, opening being formed in the container and divider means to form a passage through a wall of the container, the first compartment, the flue and a wall of the container.

DESCRIPTION OF A PREFERRED EMBODIMENT

An embodiment of the invention is described below example with reference to the accompanying drawing which is a schematic perspective view, with parts broken away, of a combustible pack of the invention.

Referring to the drawing, there is shown a rectangular parallelipipedal hollow container 10 formed from a cardboard blank. The container 10 has rectangular front and rear walls 12 and 14, side walls 16 and 18 that are narrower than the front and rear walls, a bottom wall 20, a top wall 22 formed from continuations of the front and rear walls 12 and 14. The continuations extend further and upwardly to form a carrying handle 24. The side walls 16 and 18 also have extensions 26 that have apertures therein lockably to receive corner portions 27 of the handle 24 to hold the container together.

Within and at the bottom of the container and extending from the front to the rear wall is a strip of cardboard 28 bent midway along its length so as to define therebelow a triangular section lower chamber 30 within the container and an upper chamber thereabove. A second longer cardboard strip 32 is provided extending between the front and rear walls. This strip 32 has two upright sections 34 extending upwardly from the lower strip 28, the sections 34 being equispaced about the central longitudinal plane of the container 10. These sections 34 are joined at their upper ends by a bridging piece 36 that butts against the underside of the top face 22. At their lower ends, the sections 34 have outwardly inclined portions 38 that rest on the lower strip 28 and extend to the side walls. The strip 32 thus divides the upper chamber into two compartments 40 separated by a flue 42. The sections 34 are maintained spaced apart by the bridging piece 36 and the wedging effect of the bent strip 28.

The compartments 40 contain charcoal or other convenient solid carbonaceous combustible material such as wood, coke, charcoal and the like and which is conveniently wrapped in combustible wrapping material. A firelighter 44 of known composition, such as a block of paraffin wax is contained within the lower chamber and is adhered to the bottom wall 20.

A single port or air opening 46 (which suitably has a diameter of 25 mm) is formed centrally in the front wall 12 adjacent the bottom wall and therefore communicating with the lower chamber 30. A port 48 is formed at the bend line of the strip 28 thus providing communication between the lower chamber 30 and the flue 42. A port 50 is formed through the top wall 22 and bridging piece 36 midway along the width of the top wall 22 on each side of the handle 24 and communicates with the upper part of the flue 42.

In use, the container 10 is stood in the bottom wall 20. The firelighter 44 is ignited, and being readily combustible flames easily. The flames pass up the flue 42 causing the combustion of the charcoal or other combustible material. At the same time, the cardboard forming the container and the strips 28 and 32 ignites and burns which assists in igniting the combustible material. The cardboard eventually collapses, preferably after all the combustible material has ignited.

The provision of the flue facillitates ignition and combustion of the combustible material and ensures that sufficient of the charcoal or other combustible material is ignited for its combustion to be self-sustaining before the collapse of the container. Thus the container and its contents will burn without the aid of other inflammable matter.

The invention is not limited to the precise constructional details of the embodiment hereinbefore described and a illustrated in the drawing and modifications may be made and other embodiments will become apparent without departing from the spirit and scope of the invention.

For example the charcoal chambers and flue may be formed in the container by two cardboard strips and suitable means, e.g. ears pushed out of the front and rear walls that hold the upper ends of the flue apart. Another example is that a port may be formed in an upper region of a wall of the container to communicate with the flue. Another variation is that the flue may have openings in its sides and the container may have holes or ports communicating with the compartments containing the combustible material so that flames or hot combustion gases from the ignitor passes through the combustible material. There may also be two flues instead of one only, such flues being spaced from one another and the side walls 16 and 18.

The outside surfaces of the walls may have instructional, advertising or other matter printed on them.

I claim:

1. A combustible pack comprising a container having a hollow interior, divider means separating the interior into upper and lower compartments, combustible fuel material in the upper compartments, igniting means in the lower compartment and flue means in the container extending from the lower compartment through the upper compartment.

2. A combustible pack as claimed in claim 1 in which the divider means is bent about a line in a medial region thereof so that the lower compartment is generally triangular in shape and the flue means extends from an upper portion of the bent divider means.

3. A combustible pack as claimed in claim 1 further comprising a port formed in the divider means to provide communication between the lower compartment and the flue means, at least one port formed in a lower region of a wall of the container and communicating with the lower compartment and at least one port in the upper part of the container communicating with the upper port of the flue means.

4. A combustible pack as claimed in claim 1 in which the flue means comprises a pair of spaced parallel strips equispaced from the central longitudinal plane of the container and extending between the divider means and a top wall of the container and spacing means holding the strips apart from each other.

5. A combustible pack as claimed in claim 4, in which the strips are connected to each other by a bridging piece that abuts the top wall, at least one registering hole being formed in the top wall and in the bridging piece.

6. In combination, a container, divider means for dividing the interior of the container into first and second compartments, and flue means in and forming a flue through the second compartment, openings being formed in the container and divider means to form a passage through a wall of the container, the first compartment, the flue and a wall of the container.

7. The combination of claim 6, in which the flue means and divider means are of a combustible material.

8. The combination of claim 6, in which the divider means is bent about at least one line in a medial region thereof so that the first compartment is generally triangular in shape, the flue means being positioned adjacent the bend in the divider means.

9. A combustible pack comprising:

(a) a container having a hollow interior, a top wall, a bottom wall, front and rear walls and side walls between the front and rear walls, (b) dividing means extending across the interior of the container separating the interior into upper and lower compartments, the divider means being bent about a line in a medial region thereof so that the lower compartment is generally triangular in shape, (c) flue means in the upper compartment and comprising a pair of spaced parallel strips extending between the divider means and a top wall of the container and incorporating the briding piece, holding the strips apart from each other and abutting the top wall, the lower ends of the strips being bent outwards and resting upon the divider means extending to the side walls of the container, igniting means in the lower compartment, combustible fuel material in the upper compartment but not within the flue means, (d) a port formed in a lower region of a wall of the container and communicating with the lower compartment.

(e) a port formed in the divider means providing communicating between the lower compartment and the flue means, (f) at least one port formed in the upper part of the container communicating with the upper part of the flue means.

* * * * *